US006075447A

United States Patent [19]

Nightingale et al.

[11] Patent Number: 6,075,447

[45] Date of Patent: Jun. 13, 2000

[54] SMOKE DETECTING CHRISTMAS TREE ORNAMENT SYSTEM

[76] Inventors: Michael S. Nightingale, 501 S. Shelton St., #208, Burbank, Calif. 91506; Steven H. Bliss, 1724 E. Wingate St., Covina, Calif. 91724

[21] Appl. No.: 09/213,116

[22] Filed: Dec. 17, 1998

[51] Int. Cl.[7] ..... G08B 17/10

[52] U.S. Cl. ..... 340/628; 340/693.5; 340/693.6; 340/539; 169/56; 169/61

[58] Field of Search ..... 340/628, 629, 340/630, 693.5, 693.6, 539; 169/56, 61

[56] References Cited

U.S. PATENT DOCUMENTS

| | | | |
|---|---|---|---|
| 4,623,878 | 11/1986 | Schoenwetter | 340/629 |
| 5,018,586 | 5/1991 | Cawley | 169/56 |
| 5,031,702 | 7/1991 | Trumbach | 169/61 |
| 5,396,221 | 3/1995 | Bridges | 340/628 |
| 5,821,865 | 10/1998 | Solak | 340/628 |
| 5,880,676 | 3/1999 | Tsou | 340/628 |

*Primary Examiner*—Julie Lieu

[57] ABSTRACT

A smoke detection system is provided including a plurality of smoke detector units each having a casing, an outlet cable, and an input cable. The cables of the smoke detector units are each connected end to end. Each smoke detector unit has a smoke detector for generating an activation signal upon the detection of smoke. An alarm unit is connected to the smoke units for generating an alert upon the receipt of the activation signal.

1 Claim, 4 Drawing Sheets

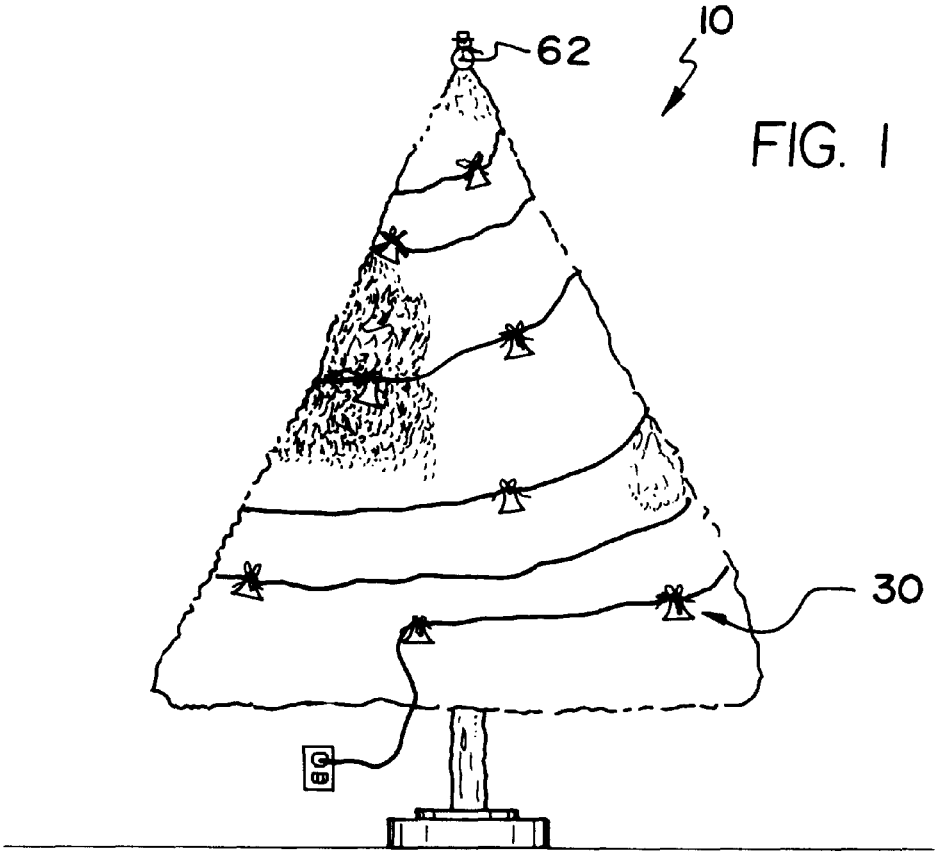
FIG. 1
FIG. 2
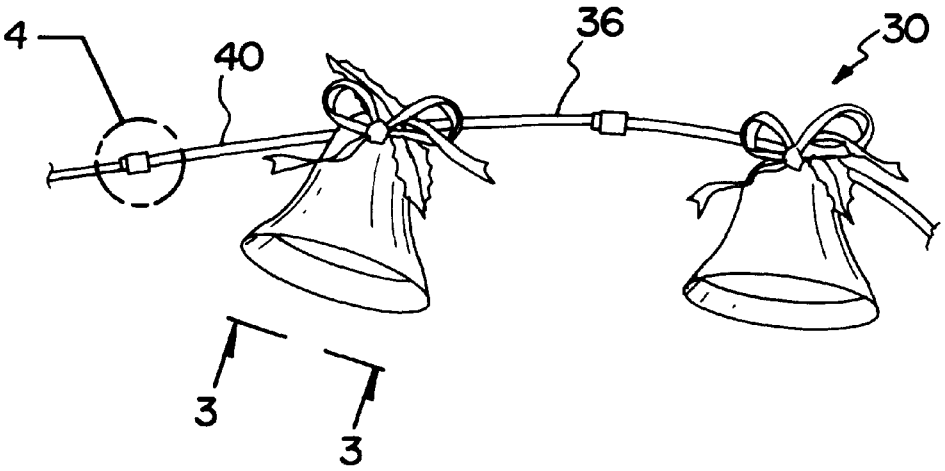

12
16
30
54
58
42
37
110
VAC
DC
POWER
SUPPLY
+V
GND
N.C.
SMOKE
DETECTOR
20
22
43
39
60

42
30
54
58
72
68
62
TEST
SMOKE
DETECTOR
+V
GND
TX
ALARM
43
60
66
70

77
73
110
VAC
DC
POWER
SUPPLY
RX
76
78

73
76
78

SMOKE DETECTING CHRISTMAS TREE ORNAMENT SYSTEM

BACKGROUND OF THE INVENTION

1. Field of the Invention

The present invention relates to smoke detectors and more particularly pertains to a new smoke detecting Christmas tree ornament system for quickly detecting a fire on a Christmas tree or other structure and alerting a user of the same.

2. Description of the Prior Art

The use of smoke detectors is known in the prior art. More specifically, smoke detectors heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,396,221; U.S. Pat. No. 4,623,878; U.S. Pat. No. 4,063,227; U.S. Pat. Des. 271,949; U.S. Pat. Des. 246,700; and U.S. Pat. No. 5,410, 299.

In these respects, the smoke detecting Christmas tree ornament system according to the present invention substantially departs from the conventional concepts and designs of the prior art, and in so doing provides an apparatus primarily developed for the purpose of quickly detecting a fire on a Christmas tree or other structure and alerting a user of the same.

SUMMARY OF THE INVENTION

In view of the foregoing disadvantages inherent in the known types of smoke detectors now present in the prior art, the present invention provides a new smoke detecting Christmas tree ornament system construction wherein the same can be utilized for quickly detecting a fire on a Christmas tree or other structure and alerting a user of the same.

The general purpose of the present invention, which will be described subsequently in greater detail, is to provide a new smoke detecting Christmas tree ornament system apparatus and method which has many of the advantages of the smoke detectors mentioned heretofore and many novel features that result in a new smoke detecting Christmas tree ornament system which is not anticipated, rendered obvious, suggested, or even implied by any of the prior art smoke detectors, either alone or in any combination thereof.

To attain this, the present invention generally comprises a power unit having a two prong plug for being removably received within an alternating current receptacle for receiving alternating current therefrom, as is conventional. As shown in FIG. 10, the transformer is positioned within a housing and has an input connected to the two prong plug. The transformer is adapted for transforming the alternating current to direct current. A battery is positioned within the housing and connected to the output of the transformer. In use, the battery is adapted to recharge upon the receipt of power from the transformer. Connected to the transformer is a wire having a male connector with a rectangular configuration. The male connector includes a top face, a bottom face, and a thin periphery. As shown in FIGS. 4 & 5, the periphery of the male connector includes three tubular inlets. Further, the top face of the male connector has a linear protrusion extending in parallel relationship with the tubular inlets. Such inlets are connected to the output of the transformer and the battery via a wire extending from the housing. Next provided is a plurality of smoke detector units each including a bell-shaped casing or any other shaped casing. As shown in FIG. 2, the bell-shaped casing is equipped with a top apex having a decorative ribbon mounted thereon and a bottom face having a bottom plate mounted thereon. This bottom face has a plurality of parallel slots formed therein. A triple strand outlet cable has a first end entering the casing at the apex thereof. The triple strand outlet wire includes pair of power outlet wires and a signal outlet wire. The triple strand outlet cable further has a second end with a male connector mounted thereon. Similar to the aforementioned male connector, the present connector has a rectangular configuration including a top face, a bottom face, and a thin periphery. This periphery has three tubular inlets while the top face has a linear protrusion extending in parallel relationship with the tubular inlets. Associated therewith is a triple strand inlet cable entering the casing at the apex thereof. The triple strand inlet cable includes a pair of power inlet wires and a signal inlet wire. The triple strand inlet cable has a female connector mounted thereon. As shown in FIGS. 4 & 6, the female connector is equipped with a rectangular configuration and a recess formed therein with three prongs mounted therein. An inner face of the recess has a linear groove extending in parallel relationship with the prongs. As shown in FIG. 10, the wires of the inlet cable are connected to the wires of the outlet cable. Further, the smoke detector units each include an ionization chamber smoke detector positioned within the casing. The smoke detector has an input connected to the power inlet wires of the inlet cable and has an output connected to a voltage controlled switch. Such voltage controlled switch is in turn connected between a grounded one of the power inlet wires and the signal outlet wire for transmitting an activation signal on the signal outlet wire upon the detection of smoke by the smoke detector. With reference now to FIGS. 9 & 11, a single alarm unit is provided including a decorative figurine with a triple strand inlet cable entering the decorative figurine. Such triple strand inlet cable includes a pair of power inlet wires and a signal inlet wire. The triple strand inlet cable has a female connector mounted thereon with structure similar to that set forth hereinabove. The alarm unit further includes a speaker positioned within the figurine and connected between the signal inlet wire and the grounded one of the power inlet wires. The speaker is adapted for emitting an audible sound upon the receipt of the activation signal. For emitting a light upon the receipt of the activation signal, a light is positioned within the figurine and connected between the signal inlet wire and the grounded one of the power inlet wires. A transmitter is positioned within the figurine and connected between the signal inlet wire and the grounded one of the power inlet wires. In use, the transmitter serves for emitting a radio signal via free space upon the receipt of the activation signal. A test button is positioned on the figurine and connected between a hot one of the power inlet wires and the signal inlet wire for providing the speaker, the light, and the transmitter with the activation signal upon the depression thereof. Finally, a portable unit includes a speaker for emitting an audible sound upon the actuation thereof. A light is included for emitting a visual indication upon the actuation thereof. As shown in FIG. 13, a receiver is connected to the speaker and the light for actuating the same upon the receipt of the radio signal.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new smoke detecting Christmas tree ornament system apparatus and method which has many of the advantages of the smoke detectors mentioned heretofore and many novel features that result in a new smoke detecting Christmas tree ornament system which is not anticipated, rendered obvious, suggested, or even implied by any of the prior art smoke detectors, either alone or in any combination thereof.

It is another object of the present invention to provide a new smoke detecting Christmas tree ornament system which may be easily and efficiently manufactured and marketed.

It is a further object of the present invention to provide a new smoke detecting Christmas tree ornament system which is of a durable and reliable construction.

An even further object of the present invention is to provide a new smoke detecting Christmas tree ornament system which is susceptible of a low cost of manufacture with regard to both materials and labor, and which accordingly is then susceptible of low prices of sale to the consuming public, thereby making such smoke detecting Christmas tree ornament system economically available to the buying public.

Still yet another object of the present invention is to provide a new smoke detecting Christmas tree ornament system which provides in the apparatuses and methods of the prior art some of the advantages thereof, while simultaneously overcoming some of the disadvantages normally associated therewith.

Still another object of the present invention is to provide a new smoke detecting Christmas tree ornament system for quickly detecting a fire on a Christmas tree or other structure and alerting a user of the same.

Even still another object of the present invention is to provide a new smoke detecting Christmas tree ornament system that includes a plurality of smoke detector units each having a casing, an outlet cable, and an input cable. The cables of the smoke detector units are each connected end to end. Each smoke detector unit has a smoke detector for generating an activation signal upon the detection of smoke. An alarm unit is connected to the smoke units for generating an alert upon the receipt of the activation signal.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side view of a new smoke detecting Christmas tree ornament system according to the present invention.

FIG. 2 is a detailed side view of one of the smoke detectors of the present invention.

DESCRIPTION OF THE PREFERRED EMBODIMENT

Figure 3:
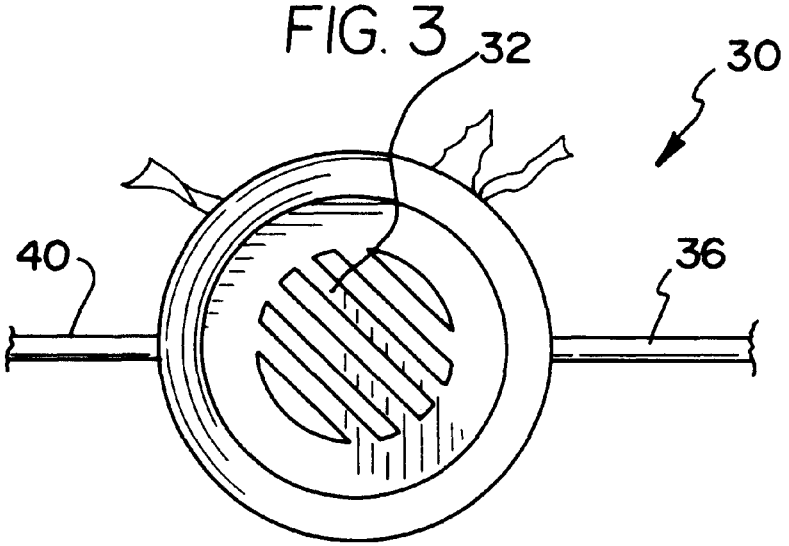
FIG. 3 is a bottom view of one of the smoke detectors of the present invention.

With reference now to the drawings, and in particular to FIGS. 1 through 13 thereof, a new smoke detecting Christmas tree ornament system embodying the principles and concepts of the present invention and generally designated by the reference numeral 10 will be described.

Figure 10:
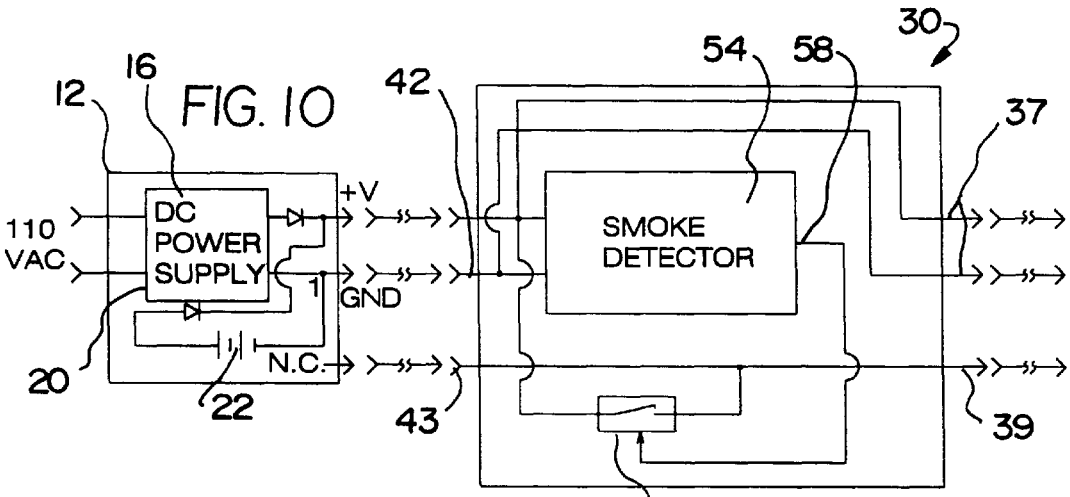
FIG. 10 is schematic diagram of one of the smoke detector units and the power unit of the present invention.

The present invention, designated as numeral 10, includes a power unit 12 having a two or three prong plug 14 for being removably received within an alternating current receptacle to receive alternating current therefrom, as is conventional. As shown in FIG. 10, the transformer 16 is positioned within a housing 18 and has an input 20 connected to the two prong plug. The transformer is adapted for transforming the alternating current to direct current. A battery 22 is positioned within the housing and connected to the output of the transformer. In use, the battery is adapted to recharge upon the receipt of power from the transformer.

Figure 4:
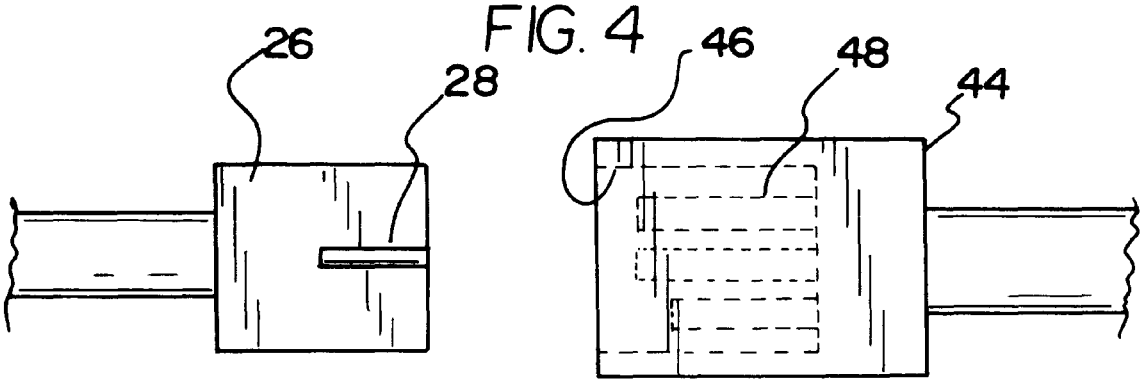
FIG. 4 is a side view of the male and female connector of the present invention.
Figure 5:
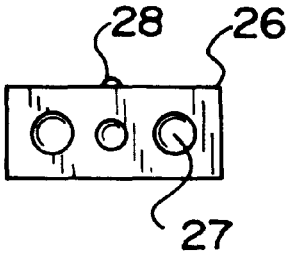
FIG. 5 is an end view of the male connector of the present invention.

Connected to the transformer is a wire 24 having a male connector 26 with a rectangular configuration. The male connector includes a top face, a bottom face, and a thin periphery. As shown in FIGS. 4 & 5, the periphery of the male connector includes three tubular inlets 27. Further, the top face of the male connector has a linear protrusion 28 extending in parallel relationship with the tubular inlets. Such inlets are connected to the output of the transformer and the battery via a wire extending from the housing.

Next provided is a plurality of smoke detector units 30 each including a bell-shaped casing or any other shaped casing. As shown in FIG. 2, the bell-shaped casing of each smoke detector unit is equipped with a top apex having a decorative ribbon mounted thereon and a bottom face having a bottom plate mounted thereon. This bottom face has a plurality of parallel slots 32 or a grate formed therein. A triple strand outlet cable 36 has a first end entering the casing at the apex thereof. The triple strand outlet wire includes pair of power outlet wires 37 and a signal outlet wire 39. The triple strand outlet cable further has a second end with a male connector mounted thereon. Similar to the aforementioned male connector, the present connector has a rectangular configuration including a top face, a bottom face, and a thin periphery. This periphery has three tubular inlets while the top face has a linear protrusion extending in parallel relationship with the tubular inlets.

Figure 6:
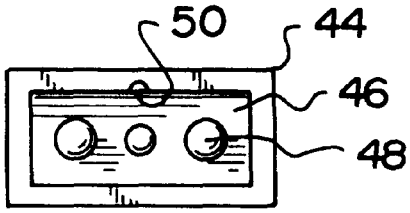
FIG. 6 is an end view of the female connector of the present invention.
Figure 7:
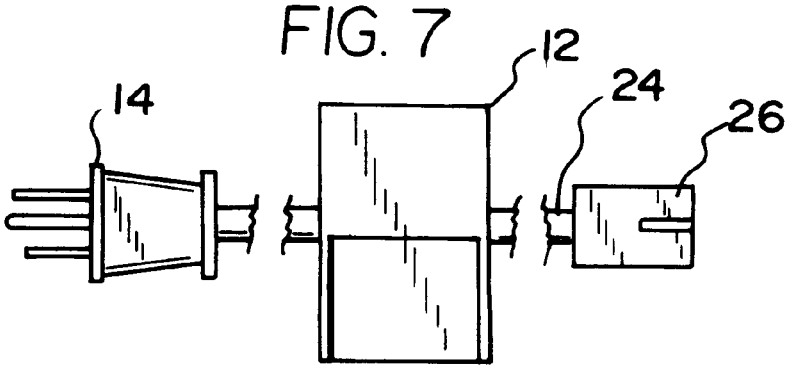
FIG. 7 is a side view of the power unit of the present invention.
Figure 8:
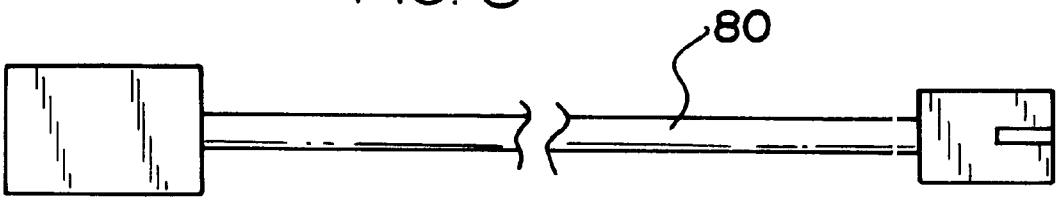
FIG. 8 is a side view of one of the bridging wires of the present invention.

Associated therewith is a triple strand inlet cable 40 entering the casing at the apex thereof. The triple strand inlet cable includes a pair of power inlet wires 42 and a signal inlet wire 43. The triple strand inlet cable has a female connector 44 mounted thereon. As shown in FIGS. 4 & 6, the female connector is equipped with a rectangular configuration and a recess 46 formed therein with three prongs 48 mounted therein. An inner face of the recess has a linear groove 50 extending in parallel relationship with the prongs.

As shown in FIG. 10, the wires of the inlet cable are connected to the wires of the outlet cable. Further, the smoke detector units each include an ionization chamber smoke detector 54 positioned within the casing. The smoke detector has an input 56 connected to a hot one of the power inlet wires of the inlet cable and has an output 58 connected to a voltage controlled switch 60. Such voltage controlled switch is in turn connected between a grounded one of the power inlet wires and the signal outlet wire for transmitting an activation signal on the signal outlet wire upon the detection of smoke by the smoke detector.

Figure 9:
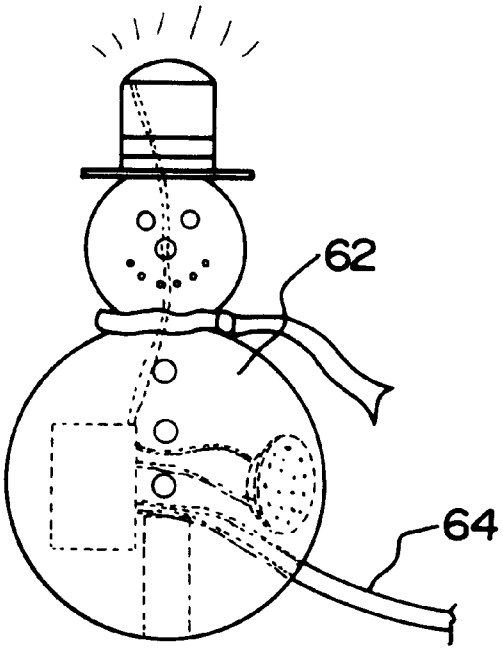
FIG. 9 is a side view of the alarm unit of the present invention.
Figure 11:
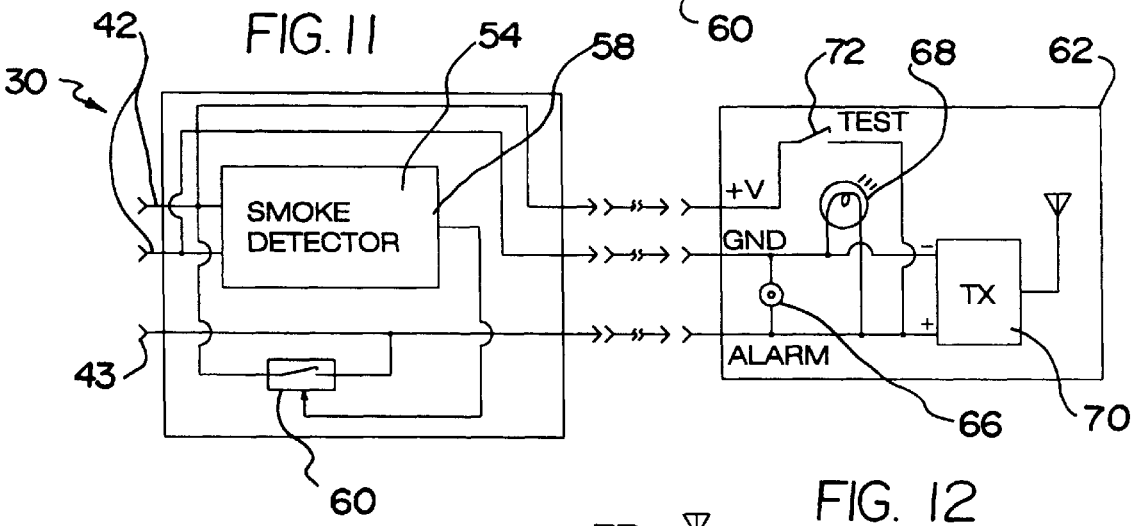
FIG. 11 is schematic diagram of one of the smoke detector units and the alarm unit of the present invention.
Figure 12:
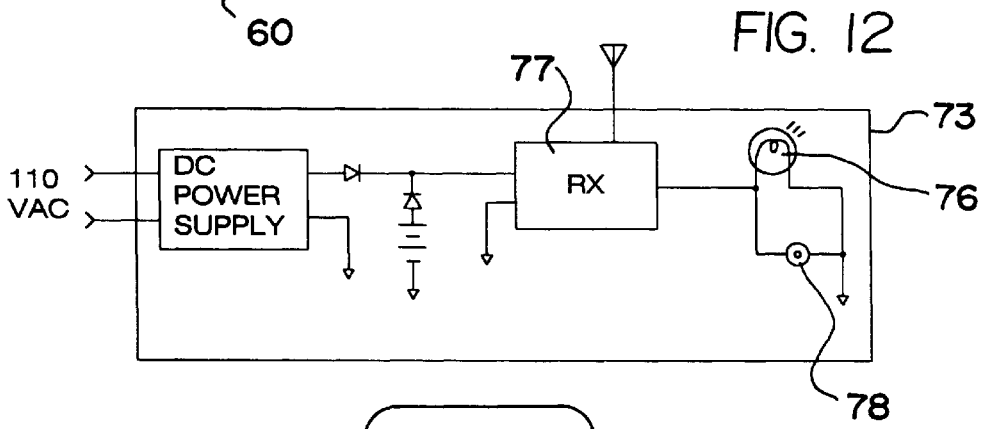
FIG. 12 is schematic diagram of the receiver of the present invention.

With reference now to FIGS. 9 & 11, a single alarm unit 62 is provided including a decorative figurine with a triple strand inlet cable 64 entering the decorative figurine. Such triple strand inlet cable includes a pair of power inlet wires and a signal inlet wire. The triple strand inlet cable has a female connector mounted thereon with structure similar to that set forth hereinabove.

The alarm unit further includes a speaker 66 positioned within the figurine and connected between the signal inlet wire and the grounded one of the power inlet wires. The speaker is adapted for emitting an audible sound upon the receipt of the activation signal. For emitting a light upon the receipt of the activation signal, a light 68 is positioned within the figurine and connected between the signal inlet wire and the grounded one of the power inlet wires. A transmitter 70 is positioned within the figurine and connected between the signal inlet wire and the grounded one of the power inlet wires. In use, the transmitter serves for emitting a radio signal via free space upon the receipt of the activation signal. A test button 72 is positioned on the figurine and connected between a hot one of the power inlet wires and the signal inlet wire for providing the speaker, the light, and the transmitter with the activation signal upon the depression thereof. Each of the foregoing components are preferably mounted on a front face of the figurine. It should be noted that the figurine may take on any form such as Santa Claus, a snowman, or an angel. In the angel embodiment, the same preferably has a pair of hands holding candles on which lights are mounted that illuminate when the present invention is actuated.

Figure 13:
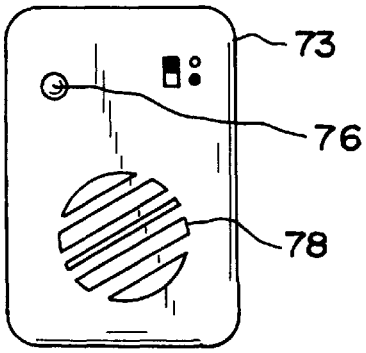
FIG. 13 is a front view of the receiver of the present invention.

Finally, a portable unit 73 includes a speaker 78 for emitting an audible sound upon the actuation thereof. A light 76 is included for emitting a visual indication upon the actuation thereof. As shown in FIG. 13, a receiver 77 is connected to the speaker and the light for actuating the same upon the receipt of the radio signal. Both the portable unit and the smoke detector units include a low power indicator mean circuit which emits an intermittent noise when a malfunction occurs or when the batteries associated therewith are low.

In use, the smoke detector units are connected end to end by way of the male and female connectors, thereby forming a string of smoke detector units. Further, the power unit is connected to a first end of the string while the alarm unit is connected to a second end of the string. The alarm unit is preferably positioned at an apex of a Christmas tree. The number of smoke detector units is a function of the size of the tree. Ideally, one of the smoke detector units constitutes a primary smoke detector unit. It is only to this unit that the power unit may be attached. To accomplish this, connectors of a unique shape are employed. As an option, the primary smoke detector unit and the power unit may be permanently coupled and/or housed in the same unit. In such embodiment, the primary smoke detector unit may be augmented in size. Per the desires of the user, up to 7, if any, secondary smoke detectors may be connected between the primary smoke detector unit and the alarm unit. It should be noted that the present invention may be positioned on any other structure per the desires of the user. By spacing a plurality of interconnected detectors about the tree, a fire is more quickly detected.

For bridging gaps, a plurality of bridging wires 80 are provided each with a first end having a male connector and a second end with a female connector. Note FIG. 8. Ideally, the length of the bridging wires is at least twice that of the inlet and outlet cables set forth hereinabove.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A Christmas tree smoke detection system comprising:

a power unit adapted for transforming alternating current into direct current; including a battery operationally connected to an output of said power unit;

a male connector with a rectangular configuration including a top face, a bottom face, and a thin periphery, the periphery including three tubular inlets and the top face having a linear protrusion extending in parallel relationship with the tubular inlets, wherein the inlets are connected to the output of said power unit and said battery via a wire;

a plurality of smoke detector units each including a casing having a bottom face having a bottom plate mounted thereon with a plurality of slots formed therein, a triple strand outlet cable with a first end entering the casing at an apex thereof and including a pair of power outlet wires and a signal outlet wire wherein the triple strand outlet cable has a second end with a male connector mounted thereon with a rectangular configuration including a top face, a bottom face, and a thin periphery including three tubular inlets and the top face having a linear protrusion extending in parallel relationship with the tubular inlets, and a triple strand inlet cable entering the casing at the apex thereof and including a pair of power inlet wires and a signal inlet wire wherein the triple strand inlet cable has a female connector mounted thereon with a rectangular configuration and a recess formed therein with three prongs mounted therein and an inner face of the recess having a linear groove extending in parallel relationship with the prongs, wherein the wires of the inlet cable are connected to the wires of the outlet cable, the smoke detector units each having a smoke detector positioned within the casing and having an input connected to the power inlet wires of the inlet cable and having an output connected to a voltage controlled switch connected between a grounded one of the power inlet wires and the signal outlet wire for transmitting an activation signal on the signal outlet wire upon the detection of smoke;

a single alarm unit with a triple strand inlet cable entering the alarm unit and including a pair of power inlet wires and a signal inlet wire wherein the triple strand inlet cable has a female connector mounted thereon with a rectangular configuration and a recess formed therein with three prongs mounted therein and an inner face of the recess having a linear groove extending in parallel relationship with the prongs, the alarm unit further including a speaker connected between the signal inlet wire and the grounded one of the power inlet wires for emitting an audible sound upon the receipt of the activation signal, a light being connected between the signal inlet wire and the grounded one of the power inlet wires for emitting a light upon the receipt of the activation signal, a transmitter positioned within alarm unit and connected between the signal inlet wire and the grounded one of the power inlet wires for emitting a radio signal via free space upon the receipt of the activation signal, and a test button positioned on the alarm unit and connected between a hot one of the power inlet wires and the signal inlet wire for providing the speaker, the light, and the transmitter with the activation signal upon the depression thereof; and a portable unit including a speaker for emitting an audible sound upon the actuation thereof, a light for emitting a visual indication upon the actuation thereof and a receiver connected to the speaker and the light for actuating the same upon the receipt of the radio signal.

* * * * *